US006253386B1

(12) United States Patent
Gafforio

(10) Patent No.: US 6,253,386 B1
(45) Date of Patent: Jul. 3, 2001

(54) ACTIVATING DEVICE OF A VISOR FOR MOTORCYCLIST HELMETS

(75) Inventor: Luca Gafforio, Comun Nuovo BG (IT)

(73) Assignee: Opticos S.r.l., Brembate di Sopra BG (IT)

( * ) Notice: Subject to any disclaimer, the term of this patent is extended or adjusted under 35 U.S.C. 154(b) by 0 days.

(21) Appl. No.: 09/416,853

(22) Filed: Oct. 12, 1999

(30) Foreign Application Priority Data

May 27, 1999 (EP) ..... 99830326

(51) Int. Cl.[7] ..... A42B 3/22
(52) U.S. Cl. ..... 2/424
(58) Field of Search ..... 2/410, 411, 424, 2/10, 6.3, 6.5

(56) References Cited

U.S. PATENT DOCUMENTS 4,242,757 * 1/1981 Nava ..... 2/10
4,247,960 * 2/1981 Nava ..... 2/424
4,297,747 * 11/1981 Nava ..... 2/424
4,615,052 * 10/1986 Nava ..... 2/424

* cited by examiner

*Primary Examiner*—Michael A. Neas
(74) *Attorney, Agent, or Firm*—Collard & Roe, P.C.

(57) ABSTRACT

An activating device of a visor for integral helmets that is kept fully embedded and flush with the helmet when the visor is in its closed position. This device is applied to an inside seat in the helmet which remains closed by the visor. The seat is disposed in the opposite sides of the helmet porthole aperture. The device comprises a base plate having an external slide mounted on the base plate. There are a series of pre-loaded springs that act on the external slide. There is also an internal slide which is translatable, parallel to the external slide within a rotary body. The rotary body has raised or grooved flanks. There are also a series of connecting rods connected to these flanks. The ends of the connecting rods are hinged on the internal slide. The opposite ends of the connecting rods are then hinged to a table bearing the visor. There is also a release lever, mounted on the base plate and pushed by a contrast spring. The release lever allows the internal slide to translate forward lifting the internal slide towards the outside of the porthole-aperture of the visor-holding table. In this position, the visor is outside the helmet and therefore it can be rotated upwards until the visor is completely open without any interference from the helmet. There is also a return lever which allows the visor to return to its original position.

6 Claims, 7 Drawing Sheets

ACTIVATING DEVICE OF A VISOR FOR MOTORCYCLIST HELMETS

BACKGROUND OF THE INVENTION

1. Field of the Invention

The invention relates to a mechanical device that is designed to keep the visor of a motorcycle safety helmet entirely embedded and flush with the cap of the helmet, when it is in closed position, to prevent surface discontinuities in the cap and, consequently, to improve its streamline.

2. Description of the Prior Art

As is known, the visors for motorcycle safety helmets and in particular the so-called "integral" helmets, are anchored on both sides of the helmet and externally with respect to the cap, to allow their lifting and lowering relative to a porthole-aperture. The porthole aperture is usually obtained above a chin protector; wherein the anchoring of the ends of the visor on the external surface of the cap, involves unattractive aesthetic effects and external encumbrances. In addition, these anchoring ends interrupt the continuity of the external surfaces of the helmet both when the visor is closed and when it is open upwards.

In addition, the present visors for integral helmets are not always able to maintain a stable closing between the peripheral gasket of the porthole-aperture and the arched surface of the visor.

SUMMARY OF THE INVENTION

Therefore, an object of the present invention is to create a mechanical device, applied to the inside right and left sides of the porthole-aperture of a helmet for motorcyclists and the like, that is designed to keep the visor entirely embedded and flush with the cap of the helmet when it is in closed position. This design allows the helmet to be free from surface discontinuities and, as a consequence, more aesthetically agreeable.

Another object of the invention is to create a device for integral helmets that is designed to remain housed on an inside face of a suitable seat disposed in the helmet and closed by the visor. This device keeps the visor entirely embedded in the edge of the helmet porthole-aperture and allows the stable stop of the visor in intermediate opening positions.

A further object of the invention is to provide a device for moving the visor, that is simple in design and easy and quick to activate and highly reliable.

These and still other objects, which will be more clearly stressed later on, are achieved by a couple of similar mechanical devices, that are hand activated and co-operate with each other, to keep the helmet visor for motorcyclists in an entirely embedded position and flush with the external surface of the helmet cap. Each of these devices comprise:

a base plate whereon a first slide is translatably mounted in both directions and with a fixed travel, wherein the first slide has on one end a raised bush and a series of preloaded thrust-springs. This bush and these thrust-springs keep the first slide pushed forwards towards the porthole-aperture of the helmet. On its opposite end, is disposed a return spring shaped as a rotating cam in opposition to a preloaded spring.

There is also a disk-like body, rotating in touch with the base plate, and having opposite raised flanks having opposite guide grooves parallel to each other and inclined with respect to the plane of the external slide.

In addition, there is also an internal slide, translatable between the raised flanks of the rotary body and having on one end, arched beveling, which engages with the bush integral with the external slide and translates together with the slide. In addition, there is on its opposite end, a pin whereon a bush rotates that is intended for freely sliding within an arched groove disposed in the base plate and concentric with the rotary body;

two pairs of bar-shaped connecting rods, each of which has an end riveted on an internal slide. There is also a pin, protruding from each flank of each connecting rod, translatable within the grooves disposed in the flanks of the rotary body. The opposite end of the pin is hinged to a plate or table for guiding and supporting means for hooking the visor to the table. These connecting rods are subject to a combined translation and rotation motion, after each shifting of the external slide, of an amplitude to cause the table to take o n a position inclined towards the outside of the helmet. This movement results in the visor being in an advanced position with respect to its closed position and ready for its rotation towards the upper part of the helmet. There is also a release lever opposite to the return spring. This release lever contains an arched profile acting on a wedge-shaped contrast means integral with the external slide. This release lever is suitable to allow the translation of the external slide by effect of its thrust springs by means of tie-rod elements or the like connecting the release lever of both devices for moving the visor and actionable from the outside of the helmet. This results in the ensuing shifting of the table and the related visor to the outside of the helmet in the position suitable to effect the rotation of the visor until it is entirely open.

More particularly, this base plate of the couple of visor activating devices is anchored in the inside of the right and left sides of the porthole-aperture of the helmet cap, opposite to each other, to allow both of the visor-holding tables to take on a similar inclined position towards the outside of the helmet.

In addition, the rotary body, rotatably mounted on the base plate, contains at least a couple of protruding teeth disposed on its periphery and spaced apart from each other and suitable to sequentially engage, a sheet spring. The engagement of the sheet spring occurs during the rotation of the rotary body, with corresponding recesses being disposed on an arched flexible element. The sheet spring is anchored to the internal peripheral edge of the base plate, to allow the table to stop in intermediate positions of the visor during the stage of upwards opening.

Still besides, the base plate has peripherally a raised edge having a gasket formed from elastically yielding material.

BRIEF DESCRIPTION OF THE DRAWINGS

Other objects and features of the present invention will become apparent from the following detailed description considered in connection with the accompanying drawings, which disclose several embodiments of the present invention. It should be understood, however, that the drawings are designed for the purpose of illustration only and not as a definition of the limits of the invention.

In the drawings wherein similar reference characters denote similar elements throughout the several views.

DETAILED DESCRIPTION OF PREFERRED EMBODIMENTS

Figure 1:
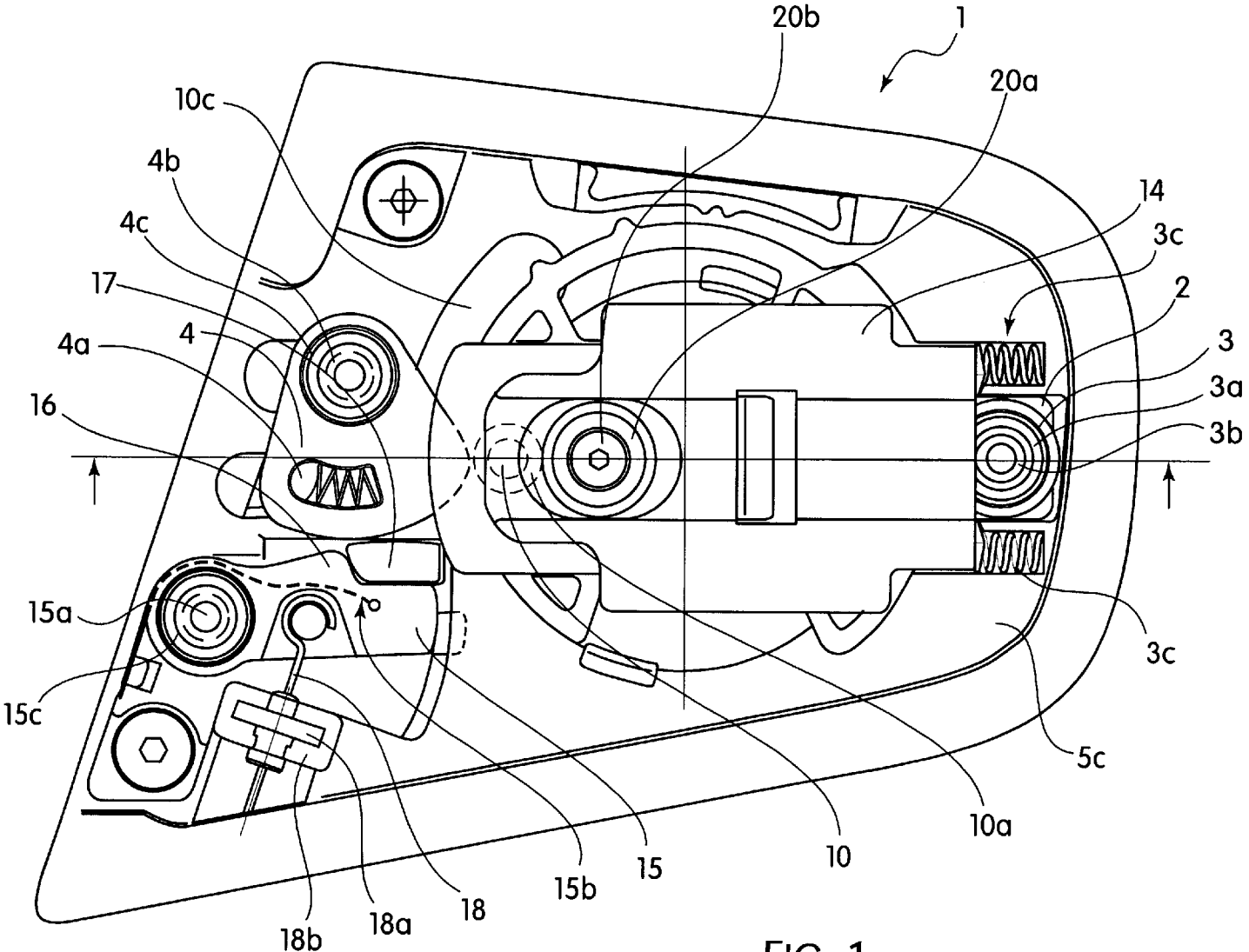
FIG. 1 shows a plan view of the device for moving the visor for helmets realized according to the present invention and illustrated with the visor in the position entirely embedded in the cap.
Figure 2:
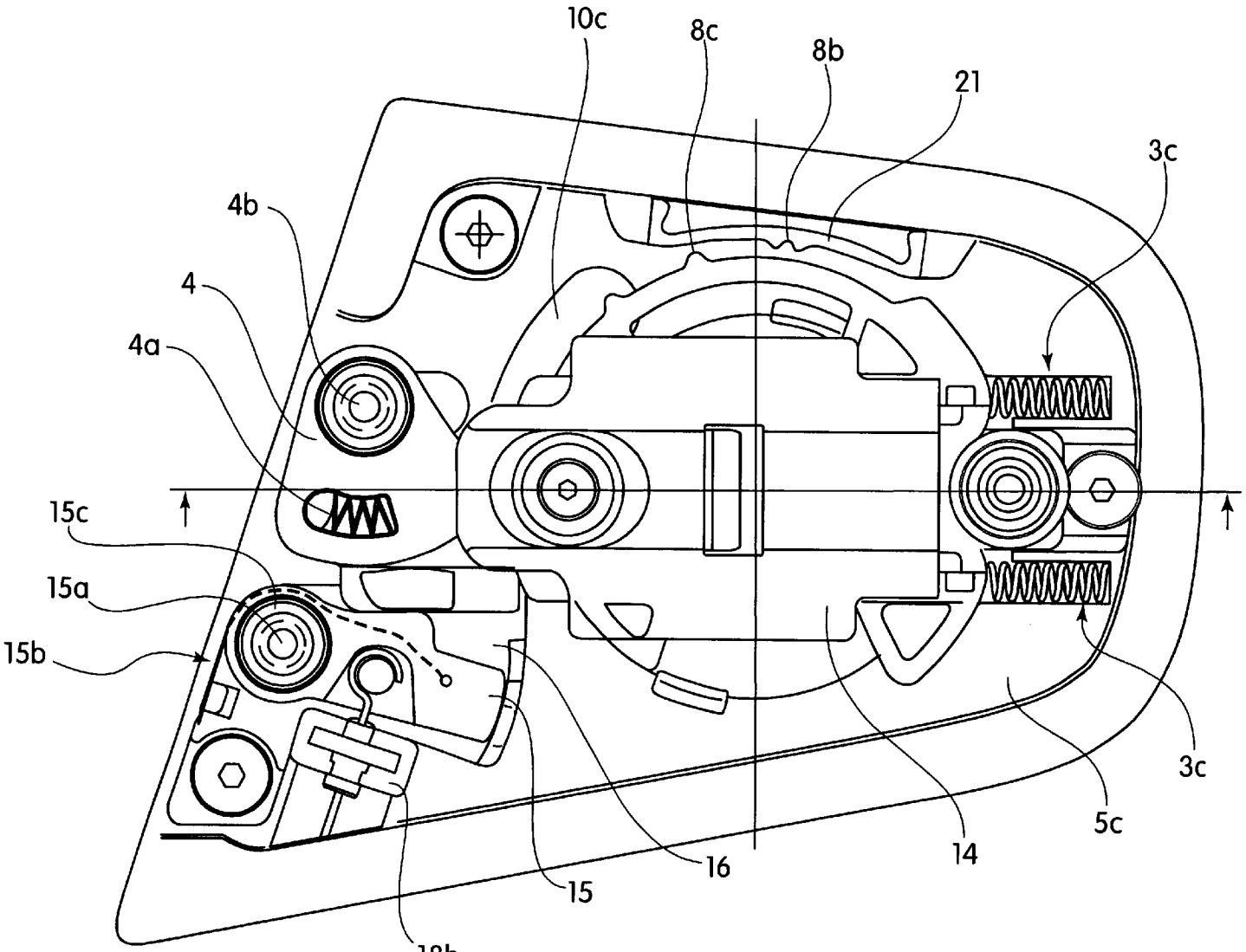
FIG. 2 shows a plan view of the same device of FIG. 1–1*a*, but illustrated in the position of initial opening shifting of the visor with respect to the cap.

Referring in detail to the drawings, FIGS. 1 and 2, show the visor in its closed position, embedded in the helmet cap, not shown.

These figures show that the device comprises a base plate 1, peripherally provided with a raised edge along all its arched perimeter.

In the middle of the flat part of base plate 1 is a rectangular seat that constitutes a guide for an external slide 2 (clearly visible in FIGS. 1*a* and 2*a*), which has at one end, a sleeve. There is also an associated bush 3*a* that rotates about a rivet 3*b* emerging from external slide 2. External slide 2 is then disposed opposite thrust springs 3*c*.

The same external slide 2 has, at the other end, a return lever 4 with a related sleeve 4*c* which is cam-shaped and rotatably mounted around a rivet 4*b* emerging from the same external slide 2 in a position opposed to a spring 4*a* (FIG. 1). In addition, external slide 2 contains a wedge 17.

Figure 1A:
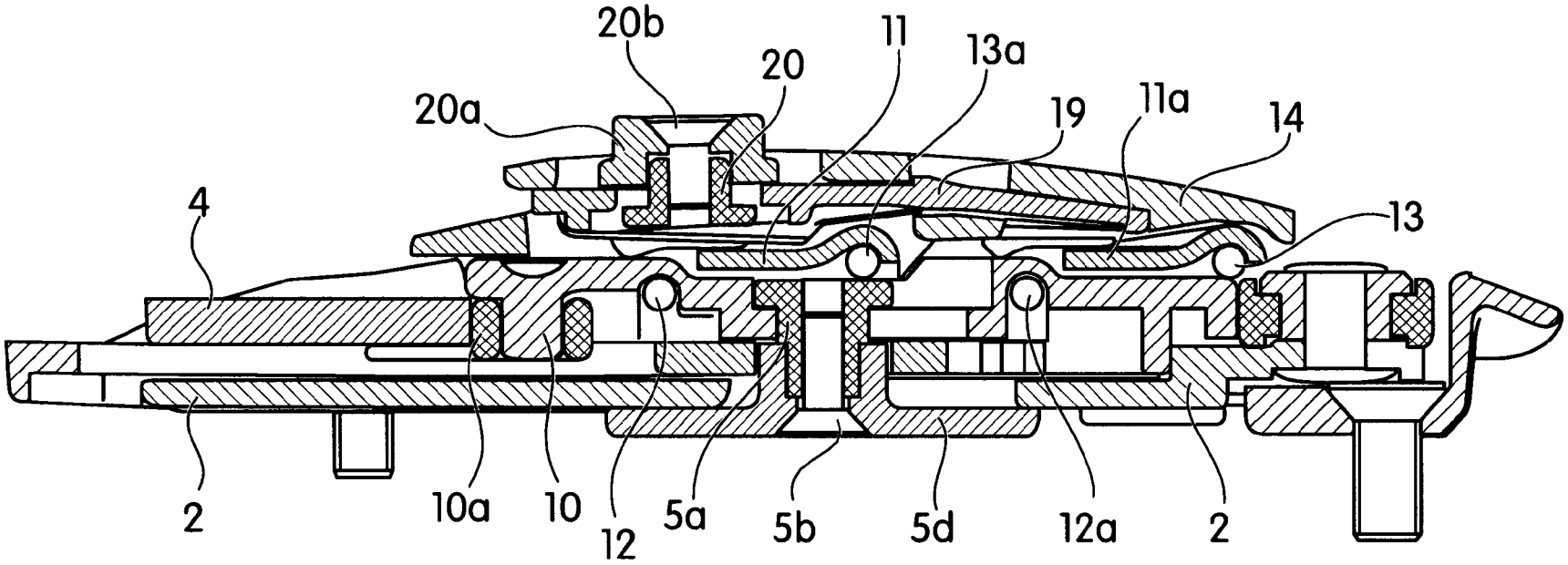
FIG. 1*a* shows a section according to the median axis I—I of FIG. 1.

The device also includes a disk-like body 5 that rotates according to a set of prefixed angle shiftings. Body 5 is located in the middle of base 1 within a sleeve 5*a* and the related restraint central screw 5*b* on the internal face of base plate 1 by interposition of a washer 5*d* (FIG. 1*a*).

Figure 1B:
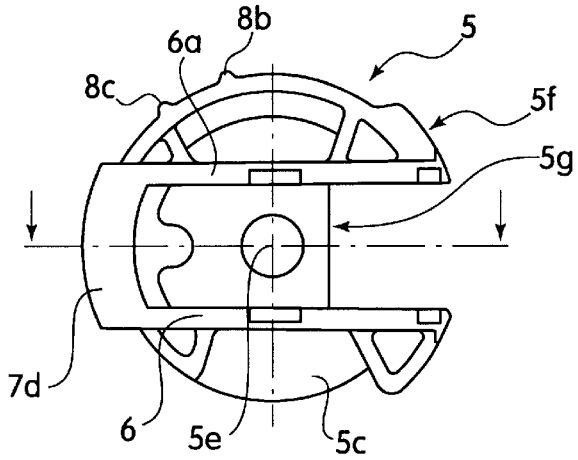
FIG. 1B shows a front view of the device.

More particularly, rotary body 5 has, as shown by the detail illustrated in FIGS. 1*b* (plan) and 1*c* (section), a disk-like base 5*c* wherefrom two parallel flanks 6–6*a* emerge, within each of which two inclined guides 7–7*a* are obtained. In addition, within the base plate 5*c* and flange 7*d* connecting the upper end so flanks 6 and 6*a*, there is a space suitable to allow the translation, in both directions, of a second slide 8, parallel to external slide 2. In addition, rotary body 5 contains at least two teeth provided peripherally and spaced apart from one another, indicated by 8*b*–8*c* in FIG. 1*b*.

Second or internal slide 8, translatable between raised flanks 6 and 6*a* of rotary body 5 and disposed above external slide 2, has on its end an arched recess or cam 8*a*. Cam 8*a* engages with bush 3*a* of external slide 2 (FIG. 1) when external slide 2 and internal slide 8 are superposed to one another and parallel to each other. For example, this occurs when the device is in such a position as to keep visor 9 in closed position, as in FIGS. 1 and 1*a*.

Figure 1C:
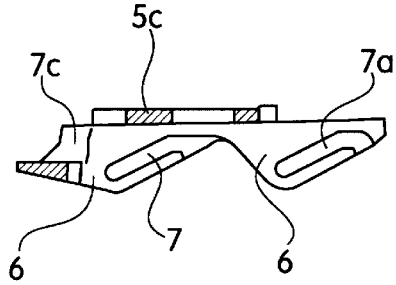
FIG. 1*c* shows a cross-sectional view of the device.
Figure 1D:
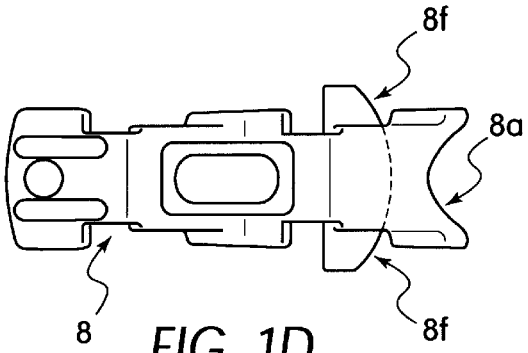
FIG. 1*d* shows a front side view of the device.
Figure 1E:
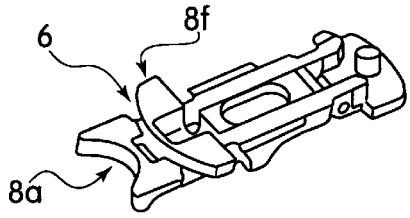
FIG. 1*e* shows a perspective view of the device.
Figure 1F:
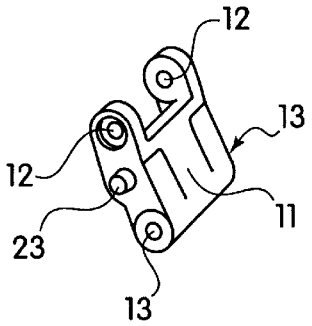
FIG. 1*f* shows a perspective view of the device.

Internal slide 8 is visible, in plan and perspective views, in FIGS. 1*e* and 1*f*. In the cross-sectional view of table 14 of FIG. 4 (which will be explained later on), only the end of internal slide 8 and the related arched beveling 8*a* are indicated.

Internal slide 8 has, on the other end, a pin 10 whereon there can freely rotate a bush (10*a*) protruding from its underlying surface and indicated by broken lines in FIG. 1. There is also a guide or arched groove 10*c* (FIG. 1), disposed in the surface of the base body 1, wherein pin 10 integral with internal slide 8 is intended to insert without sliding.

Figure 1G:
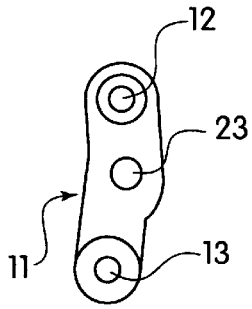
FIG. 1*g* shows a side view of the device.
Figure 2A:
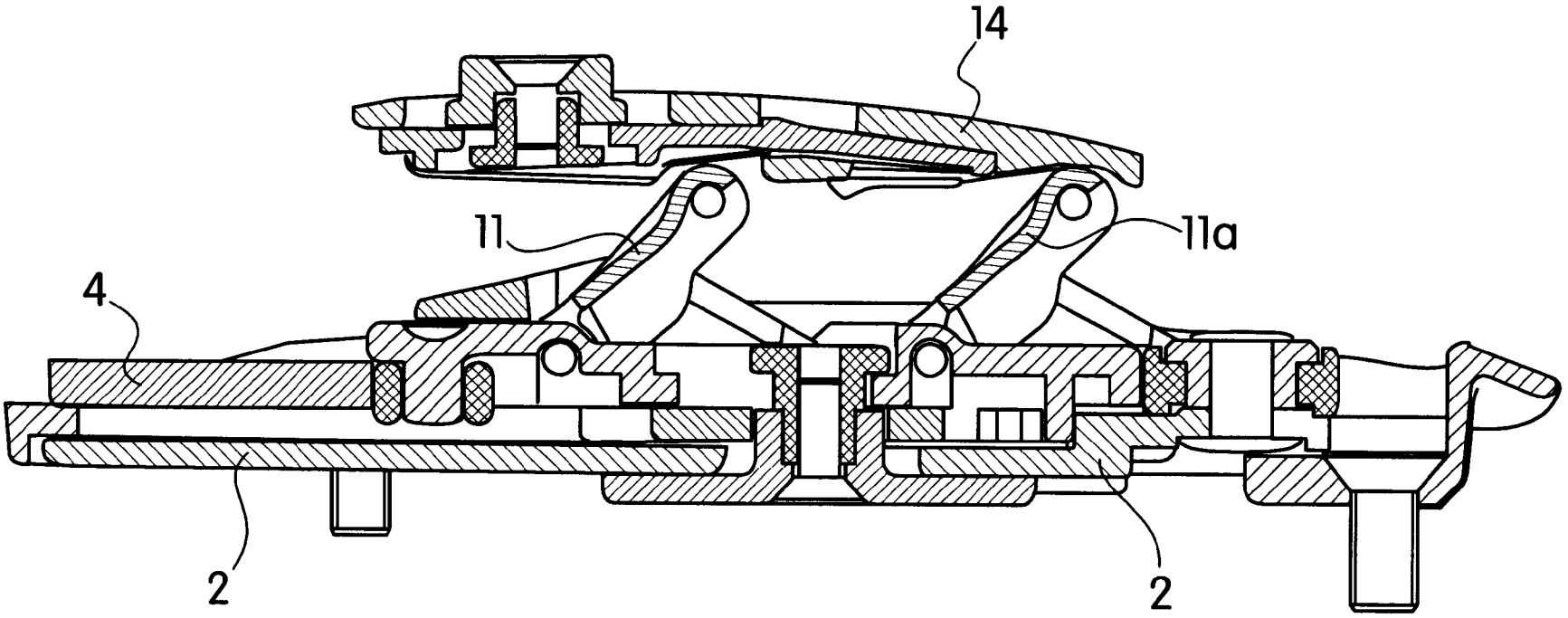
FIG. 2*a* shows a cross sectional view of the device of FIG. 1–1*a* showing the shifting of the visor.

The device also contains two sets of equal connecting rods 11–11*a*, clearly visible in FIGS. 1*a* and 2*a*, and in particular in FIGS. 1*f* and 1*g*. On each of flanks 6–6*a* is disposed a pin 23 that engages within inclined grooves 7–7*a* (FIG. 1*c*). These grooves are slidingly disposed in two flanks 6–6*a* of rotary body 5. The connecting rods also have, at the opposite ends, holes 12, 12*a* and 13, 13*a* and the related rivets caused to rotatably engage, respectively, with the flanks of internal slide 8. There is also a guiding plate or Table 14 for a further slide 19 intended for hooking visor 9 on a hooking means 20*a*. Hooking means 20*a* is mounted, by means of a screw 20*b* on a sleeve 20, integral, in an adjustable manner, with slide 19 (FIG. 1*a*). On a side of return lever 4 there is a release lever 15 of external slide 2. Lever 15 is rotatably mounted on base 1 about a rivet 15*a* with sleeve (15*c*) and in opposition with respect to a spring 15*b*, which keeps it pushed towards the end of the external lever 2.

The hooking of the release lever with external slide 2 is constituted by a contrast means 16 disposed on the edge of lever 15 (FIG. 1). Lever 15 is pushed by its own spring 15*b*, and contrasts against a protrusion 17 laterally integral with the external slide 2. In this way, spring 15*b* of the release lever keeps the thrust springs 3*c* of slide 2 loaded and therefore prevents the slide from translating towards the front part of the helmet, when the visor is in a closed position.

The release is made by activating a tie-rod 18 having a register 18*a* housed in a suitable seat 18*b* of base 1. This design causes the rotation of lever 15. In this way, the contrast exercised by the contrast means 16 against wedge 17, integral with the external slide 2, is released, allowing thrust springs 3*c* of slide 2 to translate towards the front part of the helmet.

The visor activating device described with reference to FIGS. 1–1*a*–1*b* and 1*c*, i.e., with visor 9 in an embedded position and flush with the cap, is realized in practice by a connection of tie-rods 18 of two equal devices. one of these tie rods is anchored on the right side and the other tie rod is anchored on the left side of the helmet. There is also a simultaneous tensioning of the tie-rods by means of a lever or push-button or other suitable means, anchored to the chin protector of the helmet.

By means of a connection of tie-rods 18 of the release levers and a traction through the external lever or push-button (not shown), the force exercised by spring 15*b* is overcome, because of the clockwise rotation undergone by the release lever 15. This release lever 15 disengages the contrast means 16 from wedge 17 integral with the external slide 2, causing the slide to be free of translation towards the front of the helmet.

At the same time, back bush 3*a*, which is integral with external slide 2, translates forwards. Thus, external slide 2 is in touch with cam 8*a* disposed on the internal slide 8 (FIG. 4), which also causes the latter to translate forwards.

The forward translation of internal slide 8 with respect to rotary body 5 occurs through the use of grooved guides 7–7*a*. Grooved guides 7–7*a* are disposed in the internal part of flanks 6–6*a* of rotary body 5. Flanks 6–6*a* engage pins 23 protruding from flanks 6–6*a* of the connecting rods 11–11*a*. These connecting rods undergo, both the translation caused by their being riveted to internal slide 8, and also a rotation that causes them to take on a position inclined towards the outside of the helmet.

The shifting undergone by the connecting rods 11–11*a* is transferred to table 14 by effect of the connection existing between rivets 13–13*a*. Thus, table 14 shifts to a more advanced position with respect to its starting position and more external with respect to the cap (extraction travel).

As visor 9 is connected to table 14, it also takes on a position advanced and external with respect to the starting one. As a consequence, the coupling in the close position of visor with base 1 of the mechanism does not exist any longer. The visor has therefore come out entirely from the embedding in the porthole-aperture and is ready to undergo the upwards rotation without interfering with the cap. This position is illustrated in plan in FIG. 2 and in cross-section in FIG. 2*a*.

During this stage, rotary body 5 does not undergo any movement, while also return lever 4, being integral with the external slide 2, translates forward without undergoing any relative rotation with respect to external slide 2. Lever 4 maintains contact with the underlying bush 10*a* of internal slide 8 thanks to the effect of spring 4*a* (suitably pre loaded). When the traction acting on the release lever 15 does not exist any longer, lever 15 rotates in a counter-clockwise direction by effect of its spring 15*b*, which tries to cause it to return to the starting position.

However, contrast means 16 of the release lever 15 leans now against the vertical wall of wedge 17 of the external slide 2 and therefore it cannot return, at least in this stage, to the preceding position. When visor 9 is in this advanced position, along the outline of the helmet porthole-aperture, the elastic gasket is no longer in touch with visor 9. There remains therefore a slit along the whole development of the outline of visor 9, which allows air to enter through the porthole-aperture of the helmet, causing an effective ventilation and the possible defogging of the internal surface of said visor.

However, in this position, the protection of the driver from the direct air flow and the dust, from insects, possible debris etc., that might struck during the movement, is still ensured. The visor has, in fact, undergone only one forwards translation accompanied by a deformation if its side zones.

When the mechanism is in the advanced position, rotary body 5 is free to rotate about the pin constituted by the central screw 5*b*, which ensures the tightening of a central washer with the central sleeve 5*a* on base 1 of the mechanism.

Visor 9 (FIG. 3) rotates by effect of the guides and the hole in the guides, which engage table 14 and hooking 20*a* of the visor respectively. Thus, the rotation is transmitted, through the connecting rods 11–11*a* to the rotary body 5. The free rotation of rotary body 5 is contrasted by the strength of thrust springs 3*c*, of external slide 2 through back sleeve 3 which engages with the walls of curvilinear recess 8*a*, integral with rotary body 5. The outline of walls 8*a* leaning against back sleeve 3 have a special conformation (FIG. 1*d* and FIG. 1*e*), to obtain a gradual backwards translation of the external slide 2 as the rotation of rotary body 5 increases. Back sleeve 3 is free to rotate with respect to external slide 2, which transports it thanks to the connection realized by rivet 3*b* and bush 3*a*. During such translation, in the front zone of external slide 2, return lever 4 is dragged forwards and is free to rotate about pin 10 during the backwards movement of external slide 2 because it is in touch with bush (10*a*) of internal slide 8. Herein, return lever 4 undergoes a clockwise relative rotation, contrasted by spring 4*a*, which as a consequence loads.

To reduce friction as much as possible, the bush of external slide 8 is free to rotate and is formed from a special material. In addition, the outline of the return lever 4, which couples with it has a suitable conformation.

Figure 3:
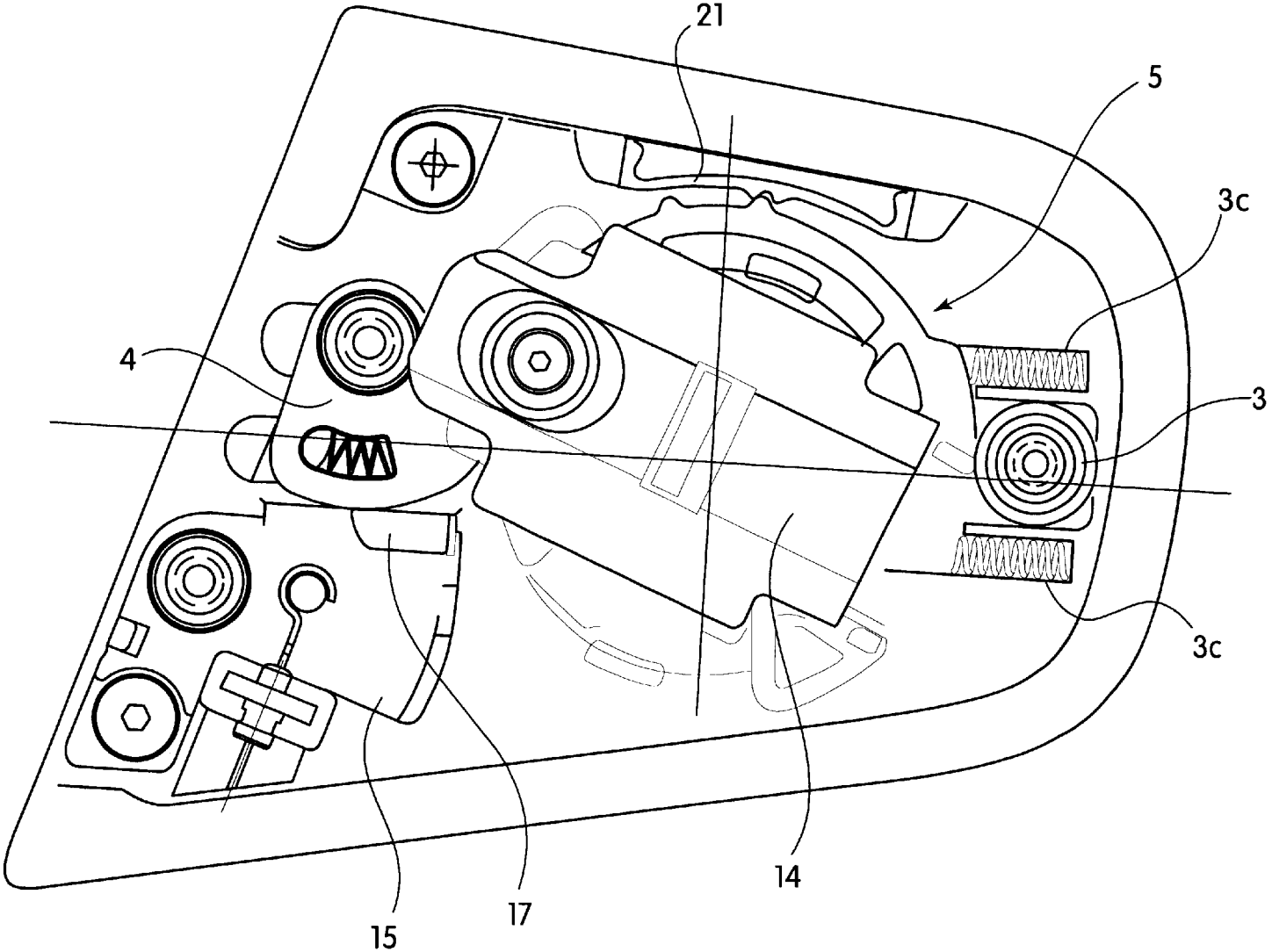
FIG. 3 shows a sectional view of the same device of the preceding figures, but with a partly rotated rotation mechanism and with the visor stopped in a first intermediate opening position.

Going on with the opening of visor 9, as illustrated by FIG. 3, when the rotary body has undergone a first rotation and external slide 2 has undergone a translation towards the back zone, the end of travel has been reached and thrust springs 3c of external side 2 are again loaded as in the starting position. In this stage, back sleeve 3 is in a position wherein the distance from rotation center 5*e* (FIG. 1*b*) of rotary body 5 is greatest, and it starts coming out from seat 8*a* obtained in the end part of internal slide 8, to continue its travel against flank 5*f* (FIG. 1*b*) of rotary body S.

Also spring 4*a* of return lever 4, has reached the maximum compression by effect of the contact of lever 4 with bush 10 of internal slide 8.

Once release lever 15 is no longer contrasted by the flank of wedge 17 of external slide 2, it is free to rotate in a counter-clockwise direction by effect of the thrust generated by spring 15*b*. In this way, the lock exercised by contrast means 16 against wedge 17 is restored. This rotation also causes the tensioning of tie-rod 18, which slides in its own guide provided with register (18*a*), returning to the starting position.

Continuing with the opening of visor 9 (see FIG. 4), back sleeve 3 of external slide 2 is caused to lean against flank 5f of the rotary body 5 and undergoes a slight forwards translation. This position is however contrasted by the lock exercised by contrast means 16 of the release lever 15 against wedge 17 of external slide 2. At the same time, bush 10a of internal slide 8 remains in touch with return lever 4, pushed by its spring 4*a*, which undergoes a counter-clockwise rotation up to the end of travel.

During rotation, first tooth 8*c*, disposed on the upper part of the rotary body, causes the bending of a spring 21, which has in its center line, a recess 22 for this tooth. After a rotation of visor 9, and rotary body 5 of about 22.5 degrees, first tooth 8*c* engages recess 22 of spring 21 whose bending is maximum. Visor 9 may remain therefore fixed in such position, intermediate between the complete closing and the complete opening, and does not tend to close by effect of gravity.

Figure 4:
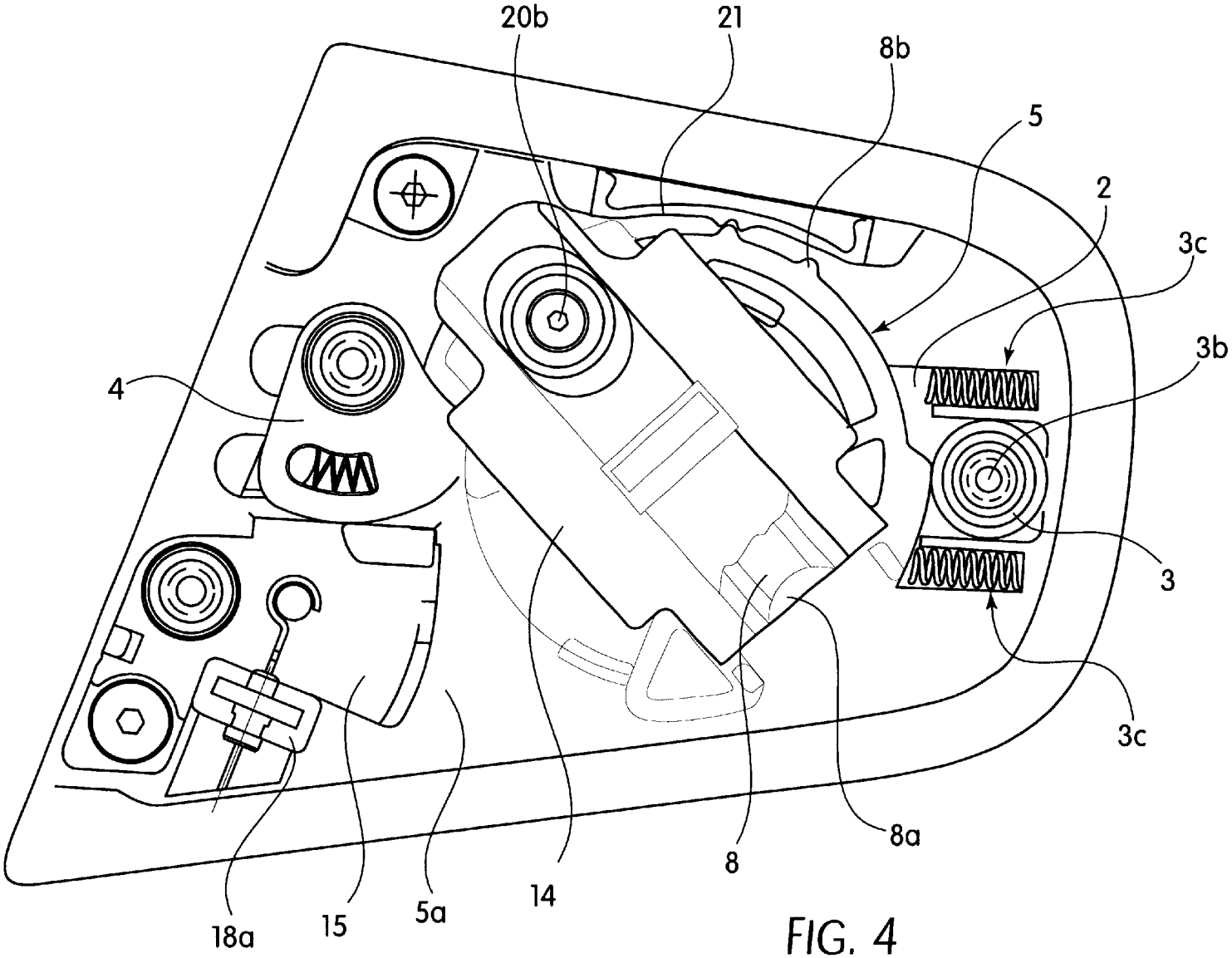
FIG. 4 shows the same device with the mechanism rotated and locked in the entirely open position of the visor.

Continuing the opening of visor 9 (as shown in FIG. 4), while first tooth 8c comes out of recess 22 of spring 21, second tooth 8*c* starts involving spring 21. When visor 9 is entirely open, after a rotation of 45 degrees, second tooth 8*c* is in the recess of spring 21, keeping visor 9 in a fixed and stable position.

Visor 9 is entirely open (as shown in FIG. 4), when rotary body 5 is rotated by 45 degrees (FIG. 4) with respect to the starting position, external slide 2 is in the back position, thrust springs 3*c* are compressed, and release 15 and return 4 levers are in the starting position (FIGS. 1 and 2). Now, it is possible to proceed to the closing of visor 9.

During the hand closing stage of the visor, there is a first portion of the rotation wherein only the force exercised by spring 21 of the intermediate releases of visor against the teeth of the rotary body 5 has to be overcome. At a certain point, bush 10*a* of internal slide 8 starts getting in touch with return lever 4, which is pushed by spring 4*a*. Continuing the closing of the visor, return lever 4 undergoes a clockwise rotation and at the same time its spring 4*a* loads elastically, such situation continues until rotary body 5 has terminated the rotation, i.e. until internal slide 8 integral with the same is aligned with external slide 2 of the mechanism. In fact, by effect of part 8*f*, (FIG. 1*d*), which has a circular outline obtained on the lower part of the back end of internal slide 8 which, striking against a complementary protrusion 5*g* (FIG. 1*b*) obtained in the rotary body 5, couples in a circular seat obtained in base 1 of the mechanism, the internal slide 8 cannot go back. As a consequence, connecting rods 11–11*a* remain standstill relative to the rotary body, and table 14 remains in the extracted position.

Back sleeve 3 is tied to external slide 2, which is locked by release lever 15, thanks to contrast means 16 that couples with wedge 17. In this stage, no contact exists with the flanks of the rotary body 5 and the seat obtained in the internal slide 8.

Starting from the position of table 14, and therefore of visor 9, extracted from the porthole-aperture, when this closing movement of the visor has been completed, internal slide 8 is aligned again with the external slide 2. Rotary body 5 has undergone all the possible rotation and has returned to the starting position. In addition, return lever 4, which in the latter stage of the closing of the visor had undergone a clockwise rotation, is still in touch with bush 10a of internal slide 8, and spring 4*a* is in the maximum compression position.

The alignment that is obtained between internal slide 8 and external slide 2 allows the outline of the lower wall of the end of internal slide 8 to engage in a rectilinear recess obtained on base 1 of the mechanism. As a consequence, by effect of the thrust of return spring 4, generated by spring 4*a*, internal slide 8 goes sharply back, translating in the inside of the rotary body 5 until it strikes back sleeve 3 of external slide 2. During such movement, external pins 23 obtained on the flanks of the connecting rods 11–11*a* are dragged in the inside of guides 7–7*a* obtained in the inside of flanks 6–6*a* of rotary body 5. As a consequence, the connecting rods return to the inclined position, dragging table 14 and the same visor, which returns to the embedded starting position.

Figure 5:
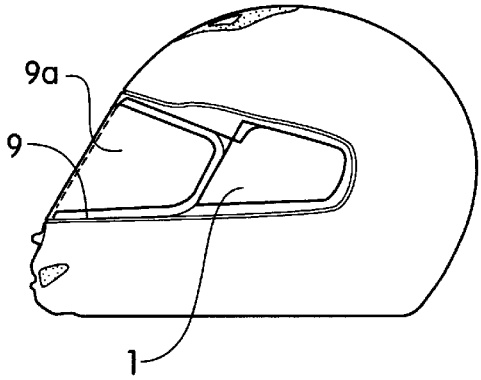
FIG. 5 shows a helmet with the hooking device of the visor and a transparent closed visor.

During this closing stage, visor 9 goes back towards the helmet and before reaching the starting position, it gets in touch with a gasket of porthole-aperture 9*a* (FIG. 5). The gasket, which being made from an elastically yielding and deformable material, is compressed between the edge of the porthole-aperture and the periphery of the visor, ensuring the sealing of the porthole aperture.

Now all the components of the device have returned to the starting position, ready to allow a new sequence of movements to realize the expulsion and therefore the opening of the visor. Lastly, in case of emergency, the helmet user may "pull" the visor forwards, i.e. he may start by hand the detachment of the visor from the cap, without activating the release device 15. In so doing, the disembedding of the visor from the cap is obtained by effect of the expulsion of tables 14 towards the outside of the helmet, as bush 10*a* of internal slide 8 is "pulled" towards return lever 4; as the latter rotates clockwise, it loads its spring 4*a*. At the end of the travel of internal slide 8, the user is able to open visor 9 by causing it to rotate upwards. During this rotation, return lever 4 rotates counter-clockwise, unloading its spring 4*a* and restoring in this way the normal use position of the device.

Accordingly, while a few embodiments of the present invention have been shown and described, it is to be understood that many changes and modifications may be made thereunto without departing from the spirit and scope of the invention as defined in the appended claims.

What is claimed is:

1. An activation device of a visor for helmets for motorcyclists, which when closed is fully embedded and flush with the helmet, applicable either on a right side and a left side of a helmet porthole-aperture, wherein the device comprises:

a) a plate-like base;

b) an external slide translatably mounted on said base;

c) a raised sleeve disposed on one end of said external slide;

d) a series of pre-loaded thrust springs attached to said external slide so as to keep said external slide pushed forwards towards a porthole aperture of the helmet;

e) a return lever disposed on an end of said external slide, opposite said series of pre-loaded thrust springs, wherein said return lever is shaped as a rotating cam in opposition to said series of pre-loaded thrust springs;

f) a disk like rotatable body coupled to said base plate, and rotating with said base plate, said disk like rotatable body having a series of opposite raised flanks, having a series of opposite guide grooves extending parallel to each other and inclined with respect to a plane of said external slide;

g) an internal slide translatable between said raised flanks of said rotary body, wherein said internal slide has arched beveling for engaging said raised sleeve integral with said external slide, so that said internal slide translates together with said external slide;

h) a pin disposed on an end of said internal slide;

i) a bush rotatably mounted on said pin;

j) a series of connecting rods, coupled to said internal slide, each of said series of connecting rods having an end riveted on said internal slide via a pin protruding from both of said flanks and translatable within said inclined grooves obtained in said flanks of said rotary body;

k) a table hinged to said series of connecting rods at an end opposite said end coupled to said internal slide, said table for guiding and supporting means for hooking said visor to said table, said series of connecting rods being subject to a combined translation and rotation motion, after a shifting of said external slide of an amplitude so as to cause said table to take on a position inclined towards an outside of the helmet, thus bringing said visor to an advanced position with respect to a closed position and ready for a rotation towards an upper part of the helmet;

l) a release lever coupled to said external slide;

m) a return spring disposed opposite said release lever;

n) a wedge shaped contrast means integral with said external slide;

o) a series of tie-rod elements each having a register connected to said release lever; and p) a series of thrust-springs disposed adjacent to said table, wherein the shifting of said table allows the visor to rotate until it is entirely open or closed.

2. The device as in claim 1, wherein said rotary body further comprises at least two protruding teeth designed to sequentially engage an internal edge of said base plate during a rotation of said rotary body wherein said teeth allow at least two stops during at least two intermediate opening positions of the visor.

3. The device as in claim 1, further comprising at least one push button coupled to said series of tie-rod elements and positioned on an outside surface of a chin protector of the helmet wherein said at least one push button is actionable by hand.

4. The device according to claim 3, wherein the visor can be opened by hand, and wherein the visor can be closed automatically when said series of connecting rods and said table are in an external position relative to the helmet such that said external and said internal slides are parallel to each other and superposed.

5. The device according to claim 1, wherein said base plate further comprises a peripheral raised edge, wherein said peripheral raised edge is coated with a gasket formed from a flexible material.

6. The device according to claim 1, wherein the device is designed to allow the visor to open by hand without using said release device wherein the visor can be opened by pulling the visor to an outside region and by dragging said internal slide towards said return lever and therefore loading said spring and rotating the visor upwards and then unloading said spring of said return lever to restore a normal use of this device.

* * * * *